United States Patent [19]

Jones

[11] Patent Number: 4,829,857

[45] Date of Patent: May 16, 1989

[54] QUICK CHANGE HANDLE FOR TOOLS

[76] Inventor: Arlan N. Jones, 1770 Glazier Dr., Concord, Calif. 94521

[21] Appl. No.: 18,524

[22] Filed: Feb. 25, 1987

[51] Int. Cl.[4] ..... B25B 23/16

[52] U.S. Cl. ..... 81/177.1; 81/177.2; 81/124.6; 81/489; 16/115

[58] Field of Search ..... 81/177.1, 177.2, 177.85, 81/489, 124.6; 16/114 R, 115 R, 111 R, 110 R

[56] References Cited

U.S. PATENT DOCUMENTS 1,195,294 8/1916 Trubey ..... 81/124.6

1,753,441 4/1930 Morehouse ..... 81/177.2

3,924,493 12/1975 Penner ..... 81/177.85

*Primary Examiner*—Frederick R. Schmidt

*Assistant Examiner*—Maurina Rachuba

*Attorney, Agent, or Firm*—Leon Gilden

[57] ABSTRACT

A removable tool handle is designed to be attached to a variety of different types of tools, such as wrenches, hammers, shovels, saws, and the like. The handle may be attached to and released from each tool by a manually operable, spring actuated catch mechanism. By using an interchangeable handle with a plurality of tool heads, a greater quantity of tools can be carried in a tool box.

1 Claim, 2 Drawing Sheets

QUICK CHANGE HANDLE FOR TOOLS

BACKGROUND OF THE INVENTION

1. Field of the Invention

The present invention relates to tools, and more particularly pertains to a new and improved tool handle construction which allows for the interchangeable use of such handle with a plurality of different tools.

2. Description of the Prior Art

The use of tools having handles which are selectively attachable thereto is well known in the prior art. For example, U.S. Pat. No. 2,565,466, which issued to F. Barker on Aug. 28, 1951, discloses a knockdown shovel wherein the handle forming a part thereof may be removed from the shovel simply by loosening a thumbscrew fastener. Similarly, U.S. Pat. No. 2,793,902, which issued to C. Govan, Jr. on May 28, 1957, is directed to the construction of a tool handle which may be used for more than one tool, such as being also utilizable with rakes, hoes, forks and the like. The Govan tool handle employs the use of a pair of metallic loops attached to a tool head with such loops being attachable to hooks formed on the tool handle. A spring biasing means is then utilized to hold the hooks and loops in secure attachment after the handle has been attached to the tool.

While both of these described detachable handle assemblies are functional for their intended purposes, both possess deficiencies which could account for their apparent lack of commercial success. For example, the Barker handle would most likely eventually become disengaged from a tool due to the undesired but to be expected loosening of the thumbscrew assembly. However, if the thum screw were tightened to the point that a loosening thereof might be prevented, it would then become difficult for the user to release the thumbscrew at a later time for the purpose of removing the handle from the tool. By the same token, the Govan tool handle could become disengaged form a tool when a substantial axially aligned force is applied to the tool head due to the undesired compression of the spring which maintains the hook and loop fasteners in engagement.

Accordingly, it can be appreciated that there exists a continuing need for new and improved easily and inexpensively manufactured handles for tools, wherein such handles could be efficiently attached to and removed from tools when desired, and in this respect, the present invention addresses this need.

SUMMARY OF THE INVENTION

In view of the foregoing disadvantages inherent in the known types of removable tool handles now present in the prior art, the present invention provides an improved removable tool handle construction wherein the same can be easily attached to and removed from a tool by a thum actuated spring-biased detect mechanism. As such, the general purpose of the present invention, which will be described subsequently in greater detail, is to provide a new and improved removable tool handle which has all the advantages of the prior art removable tool handles and none of the disadvantages.

To attain this, the present invention comprises a tubular handle formed from a lightweight and strong material, such as thin wall steel or the like, with such handle being positionable within a larger diameter tubular member integrally or otherwise fixedly secured to a tool. The tubular member extending outwardly from the tool would be of only a short length and would include a rectangularly shaped through-extending aperture formed in one walled portion thereof. The decreased external diameter portion of the tool handle, which is positionable within the conduit extending outwardly from the tool, includes a manually moveable detect of a spring-biased construction. A thumb actuated button extending through an aperture formed on the greater diameter portion of the tool handle allows a user to control the positioning of the detent, with the detent operating as a catch when it is positioned in the rectangular slot formed in the tool conduit.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved removable tool handle which has all the advantages of the prior art removable tool handles and none of the disadvantages.

It is another object of the present invention to provide a new and improved removable tool handle which may be easily and efficiently manufactured and marketed.

It is a further object of the present invention to provide a new and improved removable tool handle which is of a durable and reliable construction.

An even further object of the present invention is to provide a new and improved removable tool handle which is susceptible of a low cost of manufacture with regard to both materials and labor, and which accordingly is then susceptible of low prices of sale to the consuming public, thereby making such removable tool handles economically available to the buying public.

Still yet another object of the present invention is to provide a new and improved removable tool handle which provides in the apparatuses and methods of the prior art some of the advantages thereof, while simultaneously overcoming some of the disadvantages normally associated therewith.

Still another object of the present invention is to provide a new and improved removable tool handle which may be utilized for a plurality of tools.

Yet another object of the present invention is to provide a new and improved removable tool handle wherein such handle may be locked securely to a tool while being readily attached to and detachable therefrom.

Even still another object of the present invention is to provide a new and improved removable tool handle for use with a tool construction which is sturdy and reliable and wherein said handle may be formed of a relatively thin walled tubular stock so as to be light in weight.

These together with other objects of the invention, along with the various features of novelty which characterize the invention, are pointed out with particularlity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
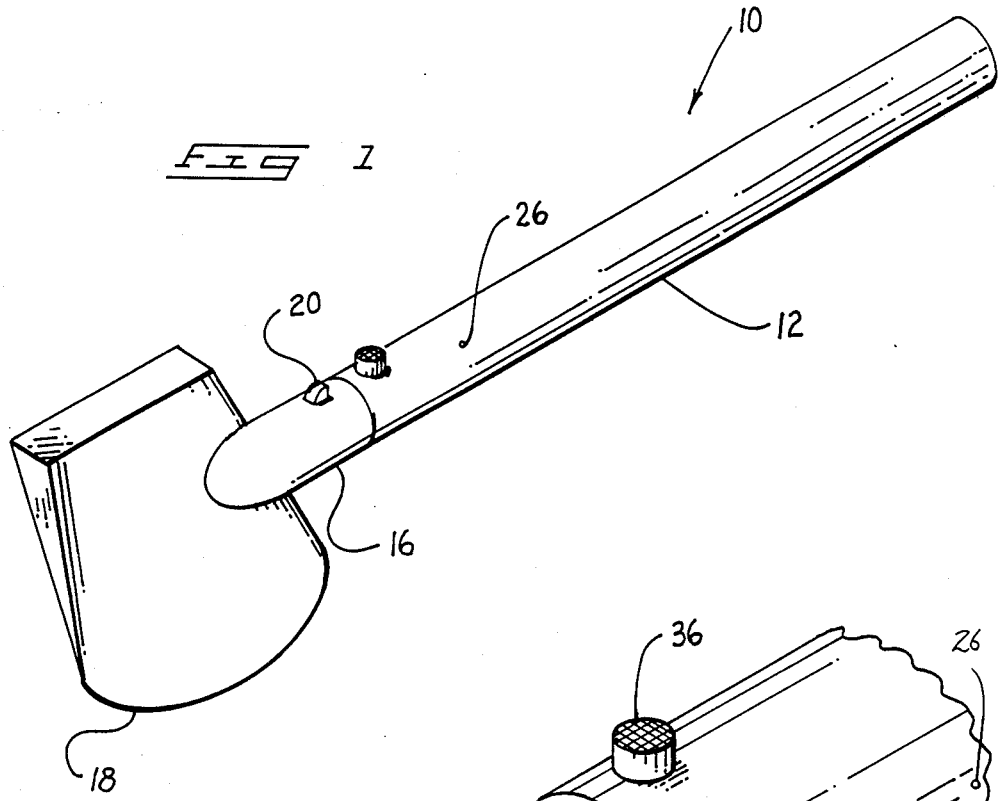
FIG. 1 is a perspective view of the tool handle comprising the present invention showing the same operably attached to a tool.
Figure 2:
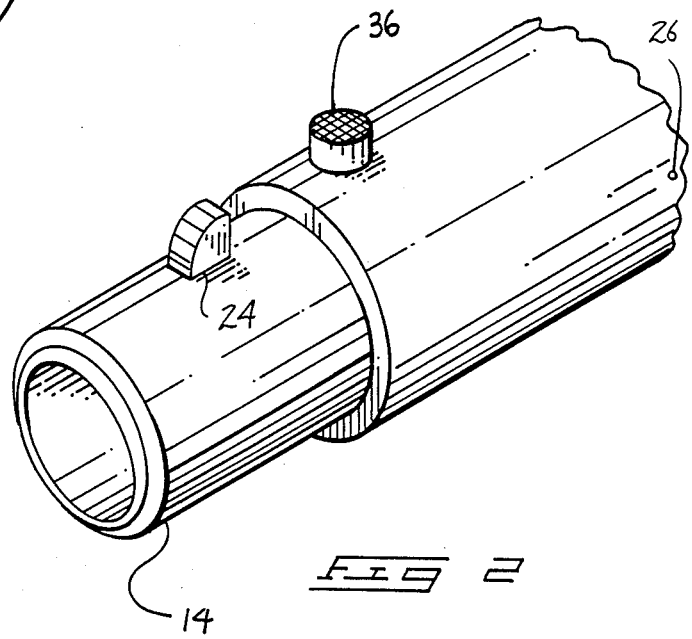
FIG. 2 is a partial perspective view of the handle illustrating the detent mechanism associated therewith.
Figure 3:
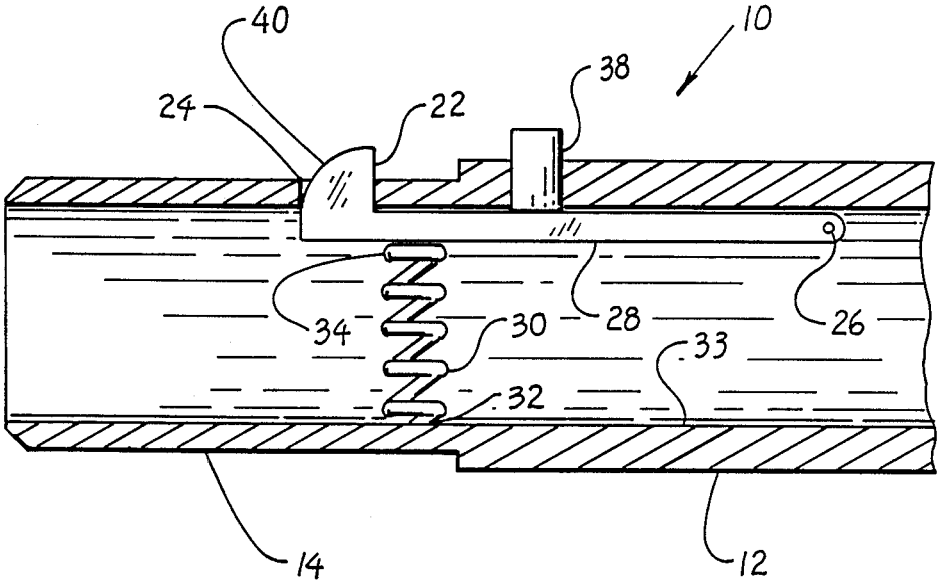
FIG. 3 is a side elevation view, partly in cross section, of the tool handle portion shown in FIG. 2.

With reference now to the drawings, and in particular to FIGS. 1, 2 and 3 thereof, a new and improved removable handle for a tool embodying the principles and concepts of the present invention and generally designated by the reference numeral 10 will be described.

More specifically, it will be noted that the tool handle assembly 10 includes a tubular thin walled handle 12 having a smaller external diameter portion 14 on one end thereof. In this respect, the handle 12 can be machined along the section 14 to reduce the external diameter of the handle in this region, with the decreased diameter portion 14 being positionable within a metallic conduit 16 which is integrally a part of or otherwise fixedly secured to a tool, such as an axe 18 or the like.

As best shown in FIG. 1, the tool attached conduit 16 includes a through-extending, rectangularly shaped aperture 20 in a wall portion thereof. A detent 22 extending through a rectangularly shaped aperture 24 in the handle section 14 is engagable with the aperture 20 in a manner which will be subsequently described. The detect 22 is permanently pivotally mounted within an interior portion of the tubular handle 12. In this regard, the detent 22 is rotatable about a pin 26 which extends through and is fixedly secured within the walls of the handle 12.

The detent 22 includes an elongated arm portion 28 that is held in axial alignment with the tubular handle 12 by means of an internally positioned helical spring 30. The spring is attached at one end 32 thereof to an internal wall portion 33 of the handle 12, with the opposed end 34 of the spring being abuttable against the arm 28, thereby to maintain the detent in an outwardly extending position through the aperture 24.

A further through-extending aperture 36 formed in the wall of the handle 12 receives a button member 38 which is also fixedly secured to the arm 28. The button member 38 controls the positioning of the arm 28 and may be fixedly secured thereto by any conventional means. A further noteworthy feature of the invention includes the curved forward surface 40 of the detent 22, wherein such curved surface operates as a cam to permit the efficient and rapid interconnection of the handle 12 to a tool 18.

As to the manner of usage and operation of the present invention, the same should be apparent from the above description. However, a brief summary thereof will be provided. More particularly, it can be appreciated that the handle 12 can be easily attached to a tool 18 through an axial insertion of the handle section 14 into the tool conduit 16. During such insertion, the cam surface 40 will slide against an interior diameter portion of the tooled conduit 16, thus to force the arm 28 in a pivotal action around the pin 26. In this respect, the arm 28 will move downwardly so as to compress the spring 30, and when the detent 22 is aligned with the tool conduit aperture 20, the spring will cause the detent to move upwardly into the aperture, thereby to lock the handle 12 in a fixed secure engagement with the tool 18. The tool 18 is now ready for use, and after such use and when it is desired to remove the handle 12, a user thereof need only to depress the button 36 to thus move the detent 22 downwardly inside the handle section 14. When the detent 22 is moved downwardly inside the handle section 14, the handle 12 can be withdrawn from the tool 18 in a now apparent manner.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A new and improved removable tool handle construction comprising:

handle means selectively attachable to one of a plurality of different tools wherein said handle means include a greater diameter portion comprising a handle and a lesser diameter portion positionable within a tubular member forming a part of said one of a plurality of different tools, and attachment means for effecting a selectively releasable attachment of said handle means to said one of a plurality of different tools, said attachment means including a spring-biased detent wherein said spring-biased detent locks said lesser diameter portion to said tubular member, and said spring-biased detent is engageable with an aperture formed in said tubular member;

said spring-biased detent includes an arcuate cammed surface for facilitating guided movement of said detect into said aperture about a first face of said detent and a planar detent surface means formed about a second face of said detent for non-slip engagement with said aperture, and wherein said detect defines a surface projecting through a further aperture formed in said lesser diameter portion of said handle means where said surface includes said first and second face; and a spring means is utilized to hold said spring-biased detent in an outwardly extended position relative to said further aperture;

said spring-biased detent includes a linear elongated arm, said cammed surface being positioned at one end of said elongated arm and a remaining end of said elongated arm being pivotally attached to an interior surface of said handle means with a pivot pin extending through a bore on said arm in said remaining end and into said handle means, and a button actuator positioned between said pivot pin and said arcuate cammed surface of said detent projecting through an opening in said greater diameter portion of said handle means for depressing said spring means and depressing said spring-biased detent from said further aperture.

* * * * *